US007129647B2

(12) United States Patent
DuLaney et al.

(10) Patent No.: US 7,129,647 B2
(45) **Date of Patent: *Oct. 31, 2006**

(54) ELECTRONIC BALLAST WITH PROGRAMMABLE PROCESSOR

(75) Inventors: James W. DuLaney, Shakopee, MN (US); Moshe Shloush, Knoxville, TX (US)

(73) Assignee: Aurora Lighting, Inc., Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/713,290

(22) Filed: Nov. 14, 2003

(65) Prior Publication Data

US 2004/0130274 A1 Jul. 8, 2004

Related U.S. Application Data

(63) Continuation-in-part of application No. 10/145,420, filed on May 14, 2002, now Pat. No. 6,650,067.

(51) Int. Cl.
*H05B 37/02* (2006.01)
*H05B 41/16* (2006.01)

(52) U.S. Cl. ..... 315/209 R; 315/247; 315/283; 315/291; 315/307

(58) Field of Classification Search ..... 315/209 R, 315/224–226, 283, 287, 291, 293, 299–300, 315/302, 307–308, 246, 247, 284
See application file for complete search history.

(56) References Cited

U.S. PATENT DOCUMENTS 4,535,271 A 8/1985 Holmes ..... 315/209 R
5,019,959 A 5/1991 MacDonald et al. ..... 363/134
5,225,742 A 7/1993 Beasley ..... 315/307
5,363,020 A 11/1994 Chen et al. ..... 315/209 R
5,416,687 A 5/1995 Beasley ..... 363/44
5,426,350 A 6/1995 Lai ..... 315/244
5,434,478 A 7/1995 Kovalski et al. ..... 315/209 R
5,569,984 A * 10/1996 Holtslag ..... 315/307
5,604,411 A 2/1997 Venkitasubrahmanian et al. ..... 315/307
5,623,187 A * 4/1997 Caldeira et al. ..... 315/307
5,677,602 A * 10/1997 Paul et al. ..... 315/224
5,680,016 A 10/1997 Valcke ..... 315/307
5,796,216 A 8/1998 Beasley ..... 315/307
5,883,475 A 3/1999 Beasley ..... 315/307

(Continued)

FOREIGN PATENT DOCUMENTS

EP 0377510 A2 11/1990

OTHER PUBLICATIONS

Sup Srch Rpt EP, Mar. 31, 2005, EPO.

*Primary Examiner*—Thuy Vinh Tran
(74) *Attorney, Agent, or Firm*—Gable Gotwals

(57) ABSTRACT

An electronic ballast circuit includes a programmable processor. The processor is programmed to vary operating parameters of the ballast circuit to accommodate operation of different types and/or sizes of lamps. Ballast circuit operating parameters that can be varied by the programmable processor include component parameters, such as inductance and resistance, and the frequency at which the ballast circuit is oscillated. The processor can be programmed to produce an oscillating processor signal which is used to produce a corresponding oscillating power signal to ignite and/or sustain ignition of the lamp. A voltage monitor and a current monitor are employed to monitor the operating condition of the lamp. The monitor outputs are used by the processor to optimize circuit operation.

24 Claims, 7 Drawing Sheets

U.S. PATENT DOCUMENTS

| | | | | |
|---|---|---|---|---|
| 5,900,701 | A | 5/1999 | Guhilot et al. | 315/307 |
| 5,914,571 | A | 6/1999 | Beasley | 315/244 |
| 6,040,661 | A * | 3/2000 | Bogdan | 315/224 |
| 6,081,077 | A * | 6/2000 | Canova et al. | 315/307 |
| 6,300,722 | B1 | 10/2001 | Parra | 315/209 R |
| 6,414,448 | B1 | 7/2002 | Noone et al. | 315/291 |
| 6,486,616 | B1 | 11/2002 | Liu et al. | 315/291 |
| 6,680,585 | B1 * | 1/2004 | Trestman | 315/291 |
| 6,844,682 | B1 * | 1/2005 | Stevens | 315/86 |

* cited by examiner

ELECTRONIC BALLAST WITH PROGRAMMABLE PROCESSOR

This application is a continuation-in-part (CIP) of U.S. application Ser. No. 10/145,420, filed May 14, 2002 and entitled Electronic Ballast For Discharge Lamps which is now U.S. Pat. No. 6,650,067.

FIELD OF THE INVENTION

The present invention relates generally to ballast circuits for operating gaseous discharge lamps. More particularly, the present invention relates to an electronic ballast with a programmable processor.

BACKGROUND OF THE INVENTION

Ballast circuits are generally used in gaseous discharge lighting systems to regulate the supply of electrical power to the lamp. The type and size of lamp to be operated are typically determinative of how the ballast circuit will be configured. For example, high intensity discharge (HID) lamps such as mercury, metal halide, and high pressure sodium lamps are usually operated at high wattage and require a different ballast circuit than lamps such as fluorescent lamps which operate at relatively low wattage. Even among lamps of the same type (i.e., mercury, metal halide, high pressure sodium, fluorescent, etc.) the specific lamp wattage can vary, which in turn requires a corresponding variance of elements within the ballast circuit in order to optimize operation of the lamps. As a result, conventional ballast circuits are unable to accommodate proper operation of different lamps types and/or lamps of the same type which operate at different wattages.

Typical ballast circuits include a starting circuit for igniting the lamp and an operating LCR (Inductor-Capacitor-Resistor) circuit for sustaining lamp ignition. In a typical ballast circuit, the same inductor is used to produce the electrical excitation necessary to ignite as well as to operate the lamp. In order to withstand large operating currents for prolonged periods of time, the inductor must be physically large, which increases the size, cost, and weight of the ballast circuit. These large inductors often operate at or near 100 percent of their duty cycle, which in turn results in significant power consumption and heating. Reliability also suffers as the effects of heating increase the failure rate of circuit components. In addition, the versatility of the lamp operating circuit suffers since the inductor used in the operating circuit must be within the operating parameters of the particular lamp being operated. Different lamps which operate at different wattages typically require a different or unique inductor to allow for proper operation of the lamp at the correct frequency. Consequently, ballast circuit designers often struggle in their attempt to find the optimal inductor for a particular lighting application.

What is needed, therefore, is a ballast circuit that eliminates one or more disadvantages of prior art ballast circuits.

BRIEF SUMMARY OF THE INVENTION

The present invention eliminates the difficulties and disadvantages of the prior art by providing an electronic ballast for supplying electrical excitation to a discharge lamp and is particularly well suited for operation of high intensity discharge lamps such as metal halide and high pressure sodium. The electronic ballast includes power conditioning circuitry for conditioning electrical power received from a source of electrical power, producing a conditioned power signal. A lamp supply circuit receives the conditioned power signal and produces electrical signals to operate the discharge lamp. The lamp supply circuit includes a programmable processor operable to vary an operating parameter of the lamp supply circuit to enable operation of a plurality of lamp types or sizes.

Operating parameters of the lamp supply circuit which can be varied by the programmable processor include component parameters such as inductance and resistance. This can be accomplished by incorporating a programmable inductor circuit having a plurality of inductance values and programming the processor to select one of the inductance values for operation of a particular lamp. Another operating parameter that can be varied by the programmable processor is the frequency at which the ballast circuit is oscillated. In accordance with this aspect of the invention, the processor is programmed to oscillate the ballast circuit at a plurality of frequencies so as to enable operation of different types and/or sizes of lamps. The processor can oscillate the ballast circuit during ignition, after ignition, or both.

The lamp supply circuit may further include an ignition circuit for producing an oscillating voltage signal for igniting the lamp, and a sustaining circuit for producing an oscillating current signal to sustain ignition of the lamp. The sustaining circuit can be advantageously configured to operate the lamp without the use of a resonant inductor. Oscillating current for sustaining ignition of the lamp may be obtained with the use of switches, such as power MOSFET devices, which switch according to the oscillating signal provided by the processor. Alternatively, the oscillating processor signal may be converted to analog format and then amplified to produce the oscillating current signal.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
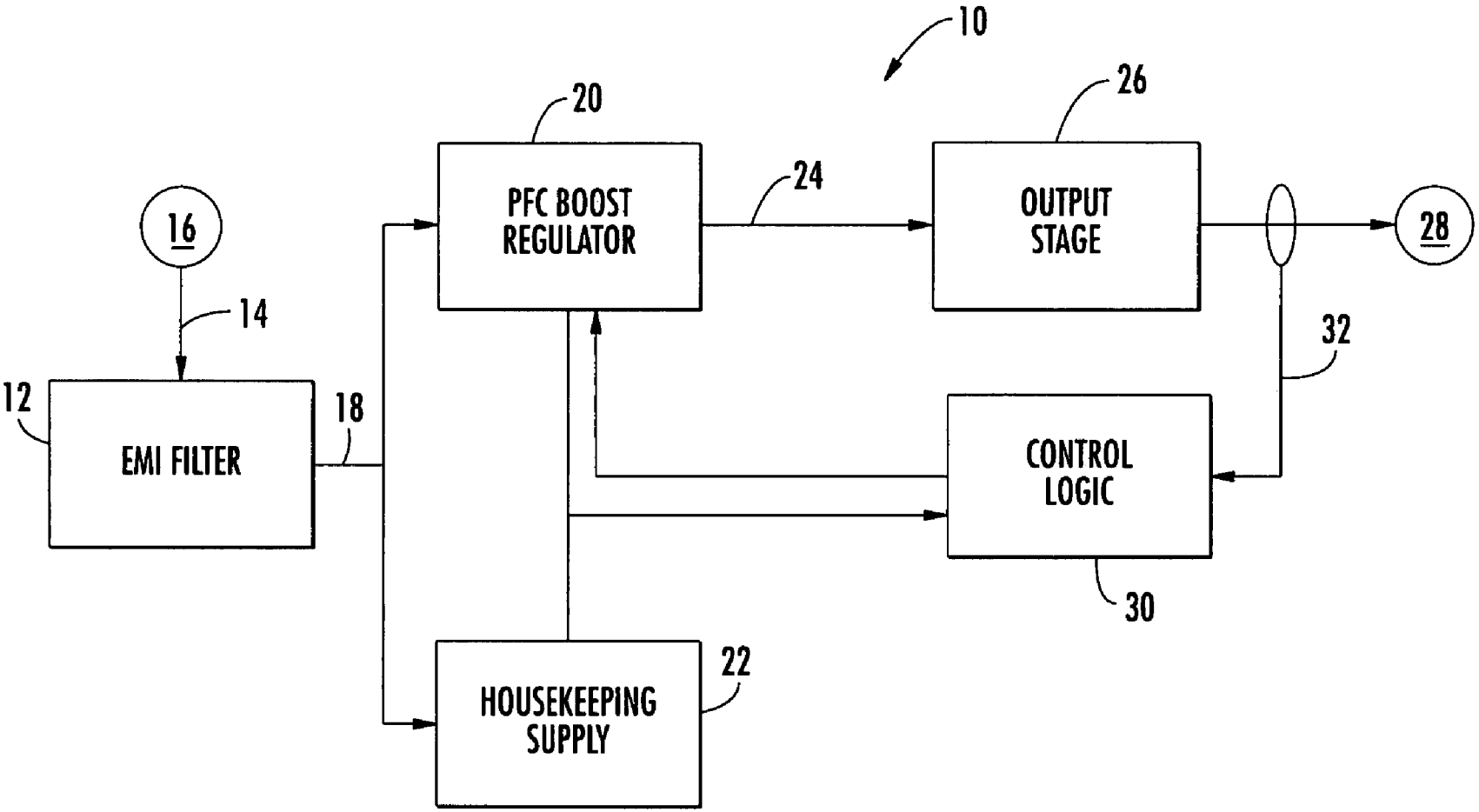
FIG. 1 is a functional block diagram of an electronic ballast circuit according to the present invention.

Preferred embodiments of the present invention will now be described with reference to the accompanying drawings, wherein like reference characters designate like or similar parts throughout. The terminology used herein is intended to be interpreted in its broadest reasonable manner, even though it is being utilized in conjunction with a detailed description of certain specific preferred embodiments of the present invention. This is further emphasized below with respect to some particular terms used herein. Any terminology intended to be interpreted by the reader in any restricted manner will be overtly and specifically defined as such in this specification.

FIG. 1 illustrates a functional block diagram of an electronic ballast circuit 10 according to a preferred embodiment of the invention. The ballast circuit 10 includes an electromagnetic interference (EMI) filter circuit 12 which functions to remove noise from an electrical power signal 14 provided by an electrical power source 16. In a preferred embodiment, the filter circuit 12 includes a low-pass filter. Also preferably, the EMI filter circuit 12 is tunable to accommodate different types and levels of noise in the incoming power signal 14.

The filtered power signal 18 is provided to a power factor correction (PFC) boost regulator circuit 20 and a power supply housekeeping circuit 22. The power factor correction circuit 20 adjusts the filtered power signal to correct for power factor. As more fully explained below, the power factor can be corrected either automatically through sensor feedback or manually through dip switches. Preferably, the power factor correction circuit 20 includes one or more circuit elements with variable parameters to enhance the ballast circuit's ability to accommodate different types and/or wattages of discharge lamps.

The housekeeping/power supply circuit 22 functions to convert the incoming filtered power signal to a power level sufficient to operate the electronic ballast 10. In a preferred embodiment, the ballast circuit 10 is operated by a 15-volt supply provided by the power supply circuit 22. A voltage regulator within the power supply circuit 22 maintains the supplied power between about 12 to 15 volts dc. The housekeeping/power supply circuit 22 also provides overheat protection by shutting down operation of the ballast circuit 10 when an overheat condition exists. The EMI filter circuit 12, PFC boost regulator circuit 20, and power supply circuit 22 collectively form a preferred arrangement of power conditioning circuitry for conditioning electrical power received from a source of electrical power and producing a conditioned power signal for use in powering a discharge lamp.

The corrected power signal 24 produced by the power factor correction circuit 20 is received by a lamp supply circuit or output circuit 26 which functions to operate (i.e., ignite and/or sustain ignition) a gaseous discharge lamp 28. Discharge lamps suitable for use with the ballast circuit 10 include mercury, metal halide, and high pressure sodium lamps. As discussed below, the lamp supply circuit or output circuit 26 preferably includes a programmable processor operable to vary one or more operating parameters of the lamp supply circuit to enable operation (ignition and/or post-ignition operation) of a plurality of lamp types and/or sizes. Operating parameters which may be varied by the programmable processor include, but are not limited to, component parameters, such as inductance and resistance, and the frequency at which the ballast circuit is oscillated. Output circuit parameters can be varied by incorporating a programmable circuit element(s), such as a programmable inductor circuit with a plurality of inductance values (as further discussed below), into the ballast circuit and programming the processor to select one of the inductance values for operation of a particular lamp type or size. Alternatively, output circuit parameters can be varied by programming the processor to produce an oscillating processor signal that is used to oscillate the output circuit 26 at a plurality of frequencies, which enables the output circuit 26 to operate discharge lamps of varying type and/or size.

A control logic circuit 30 controls operation of the ballast circuit 10, including ignition and post-ignition operation of the lamp 28. Sensor feedback on line 32 is utilized by the control circuit 30 to determine when the lamp 28 has ignited.

Figure 2:
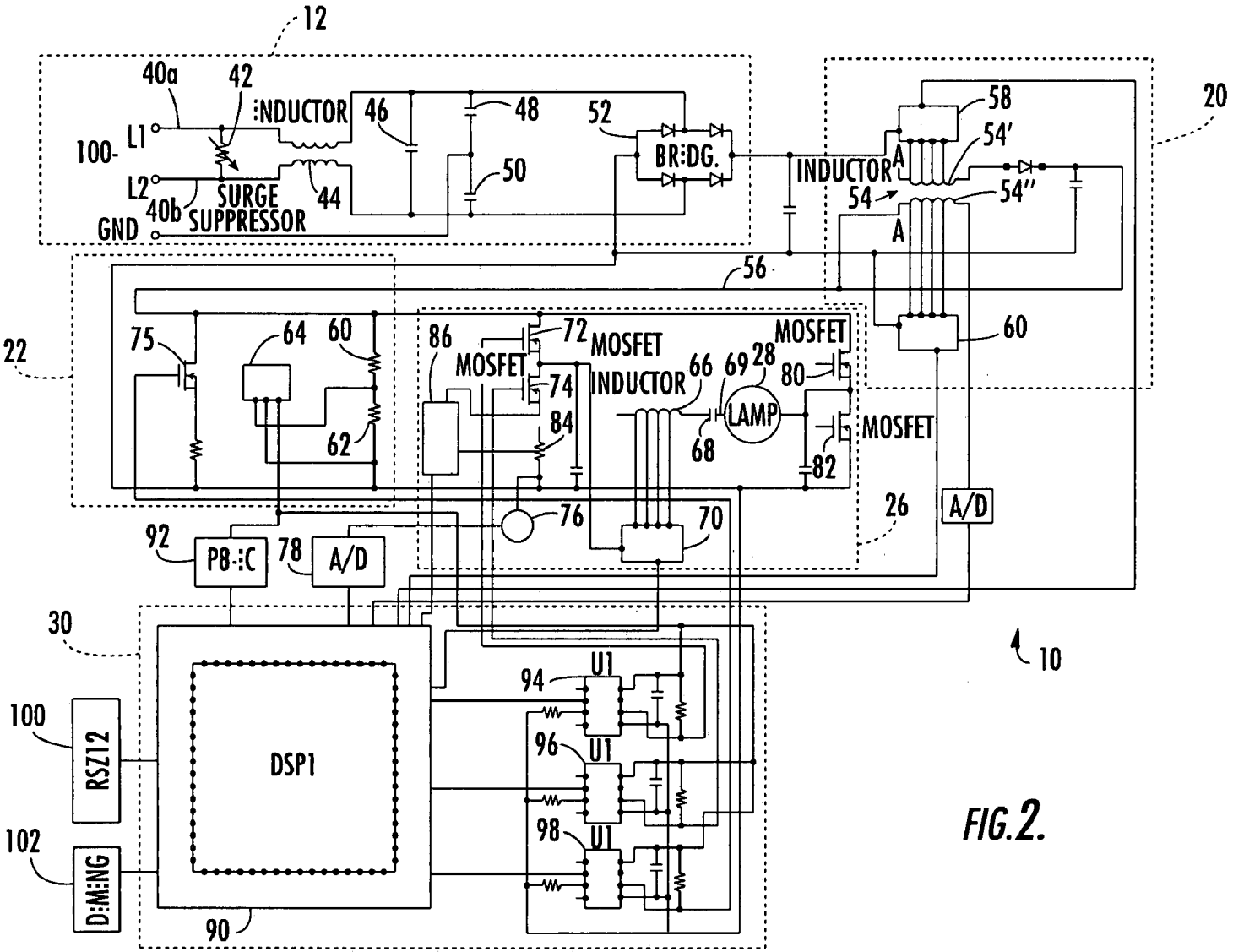
FIG. 2 is a schematic diagram of an electronic ballast circuit according to the present invention.
Figure 3:
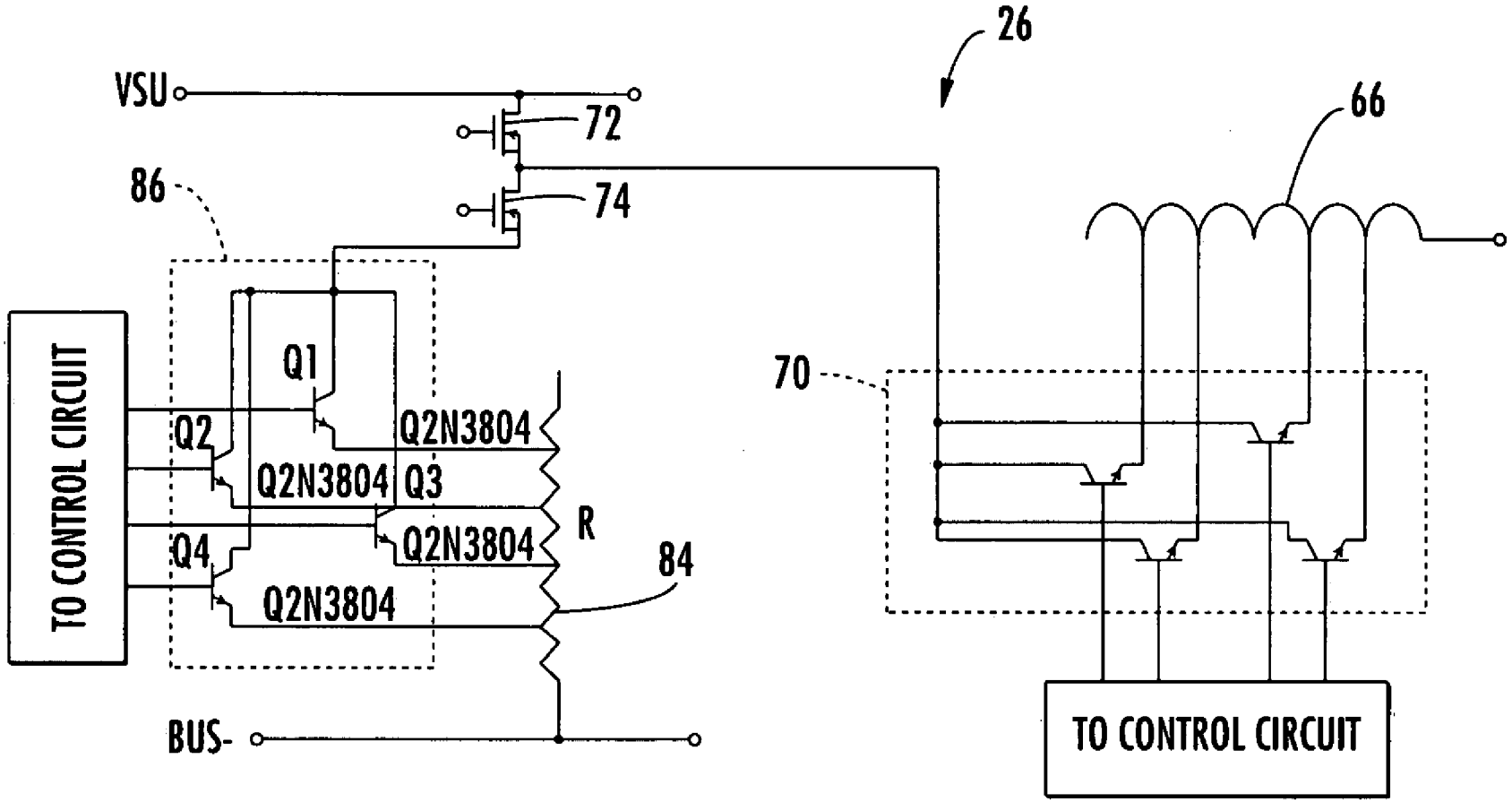
FIG. 3 is a schematic diagram showing elements of an output/lamp supply circuit according to the present invention.

A preferred embodiment of the ballast circuit 10 shown in FIG. 1 will now be described with reference to FIGS. 2 and 3. Each of the functional blocks of FIG. 1 are generally shown by use of broken line blocks in FIG. 2, it being understood that components shown within a particular block may provide functions that relate to one or more other functional blocks. For example, although programmable processor 90 is shown in FIG. 2 as forming part of the control logic circuit 30, the programmable processor 90 may also function as an important part of the output circuit 26 in helping to produce electrical signals to ignite and/or sustain ignition of a discharge lamp 28.

Within the filter circuit 12, power surges experienced on incoming power lines 40*a*, 40*b* are suppressed by a surge suppressor 42. The ballast circuit 10 can accommodate either ac or dc power. Inductor 44 and capacitors 46–50 act as a low-pass filter to remove unwanted components from the power signal. A full bridge circuit 52 rectifies the power signal before it is received by the power factor correction circuit 20 and the housekeeping/power supply circuit 22. Parameters of the filter circuit 12 may be tunable to provide different levels of conditioning of the incoming power signal as desired or needed.

In a preferred embodiment, the power factor correction circuit 20 includes a programmable inductor circuit having a plurality of selectable inductance values for varying the amount of power factor adjustment and enhancing the ability of the ballast circuit 10 to ignite and operate different lamps 28. In such an embodiment, the programmable inductor circuit preferably includes a programmable inductor 54 having a primary winding 54' and a secondary winding 54" which function to adjust the power factor of the incoming power signal and produce a corrected power signal on line 56. Inductor 54 includes a plurality of selectable inductance values for varying the amount of power factor adjustment as needed. For example, a higher inductance value increases the amount of power factor compensation and a lower inductance value decreases the effective power factor compensation. Preferably, each winding 54', 54" of inductor 54 has an associated switch 58, 60. The switches 58, 60 have multiple switch positions which tap the inductor winding at different points so that each switch position results in a different inductance value, and hence, a different amount of power factor adjustment. The positions of switches 58, 60 are controlled by the control circuit 30.

In an alternate embodiment of a programmable inductor circuit, a plurality of inductors are provided with each inductor having a different inductance value. In this alternate embodiment, the control circuit 30 operates to select an individual inductor to adjust the power factor of the power signal.

In lieu of a programmable inductor circuit, the power factor correction circuit 20 may employ a discrete inductor with a non-variable inductance value selected for use in a particular lighting application.

The corrected power signal 56 is provided to the housekeeping/power supply circuit 22 and the output circuit 26. Within the power supply circuit 22, resistors 60, 62 form the basic elements of a voltage divider which provides low level voltage for operating the ballast circuit 10. A voltage regulator 64 regulates the voltage divider output to maintain a desired voltage level for operating the ballast circuit 10. In a preferred embodiment, voltage regulator 64 maintains a voltage range of between about 5 volts dc to about 15 volts dc.

With continued reference to FIG. 2, the output circuit 26 includes a resonant inductor 66 and capacitor 68 which form part of an ignition circuit that provides an oscillating voltage signal on line 69 to ignite the lamp 28. For purposes of simplifying the schematic of FIG. 2, the lamp 28 is shown as part of the output circuit 26. Preferably, the voltage signal 69 is oscillated at high frequency between about 60 KHz to about 500 KHz and at high voltage of about 1 KV or greater.

To enhance the ability of the ballast circuit 10 to accommodate lamps 28 of different types and wattages, the resonant inductor 66 is preferably programmable and includes a plurality of selectable inductance values for varying the frequency and voltage as needed. For example, an increase in the inductance value of inductor 66 functions to increase the voltage and oscillation frequency, while a decrease in the inductance value of inductor 66 results in a corresponding decrease of voltage and frequency. In a preferred embodiment, the resonant inductor 66 has an associated switch 70 with multiple switch positions which tap the inductor winding at different points so that each switch position results in a different inductance value, and hence, a different ignition signal on line 69. The position of switch 70 is controlled by the control circuit 30, and more particularly by DSP 90 which, as previously discussed, may be considered to form a part of the output circuit 26 as well. A more detailed illustration of components within the output circuit 26 is shown in FIG. 3.

In an alternate embodiment, the resonant inductor 66 is replaced with a plurality of inductors with each inductor having a different inductance value. In this alternate embodiment, the control circuit 30 operates to select an individual inductor to adjust the voltage signal on line 69 as needed. Electrical power for igniting the lamp 28 is provided to switch 70 by a pair of power MOSFET devices 72, 74.

In a further alternate embodiment, the resonant inductor 66 is a discrete inductor with a non-variable inductance value selected for use in a particular lighting application.

During initial power up of the ballast circuit 10, the lamp 28 is seen as a very high impedance device with little or no current flowing through the output circuit to the lamp 28. Upon ignition of the lamp 28, current flows through the output circuit to the lamp 28. A current sensor 76 senses the start of current flow to the lamp 28 and provides such an indication to the control circuit 30. An analog-to-digital converter 78 digitizes the current sensor output for use by the control circuit 30. The control circuit 30 then controls post-ignition operation of the lamp 28 by establishing an oscillating current signal on line 69 across the lamp 28. More precisely, after ignition of the lamp 28, current flows from resistor 84 and power MOSFET devices 72, 74, through switch 70 and resonant inductor 66, and through the lamp 28 and power MOSFET devices 80, 82. Thus, the programmable resistor 84, DSP 90, switches 86, 70, resonant inductor 66, and power MOSFET devices 72, 74, 80, 82 form the major components of a preferred sustaining circuit for sustaining operation of the lamp 28 after ignition. The power MOSFET devices 72, 74, 80, 82 are also preferably double gated transistors, it being understood that any suitable switching device may be employed in lieu of a double gated power MOSFET device.

While power MOSFET devices 72, 74 are shown in a half bridge configuration, it will be understood that in an alternate embodiment a full MOSFET bridge with two additional power MOSFET devices may be provided as part of the sustaining circuit so as to increase the amount of current available for operating the lamp 28. Preferably, the current signal 69 is oscillated at high frequency between about 60 KHz to about 500 KHz, or greater. Oscillating the voltage signal 69 during ignition and the current signal 69 during post-ignition operation at high frequency eliminates most or all of the acoustic distortion and strobbing that typically occurs when discharge lamps are operated at lower frequencies. It also helps to increase the life of the lamp 28.

A programmable resistor 84 having a plurality of programmable resistance values enables the level of current flow across the lamp 28 to be varied as needed, which in turn enhances the ability of the ballast circuit 10 to operate lamps of different types and/or wattages. In a preferred embodiment, the programmable resistor 84 has an associated switch 86 with multiple switch positions which tap the resistor 84 at different points so that each switch position results in a different resistive value, and hence, a different level of current flow across the lamp 28. As configured in FIG. 2, an increase in the resistive value of resistor 84 results in a corresponding decrease in current, while a decrease in the resistive value of resistor 84 functions to increase current across the lamp 28. The position of switch 86 is controlled by the control circuit 30, and more particularly by the DSP 90 which may also be considered to form a part of the output circuit 26.

In an alternate embodiment, the programmable resistor 84 is replaced with a plurality of resistors with each resistor having a different resistive value. In this alternate embodiment, the control circuit 30 operates to select an individual resistor to set the flow of operating current across the lamp 28 as needed.

The control circuit 30 embodiment of FIG. 2 includes a programmable processing circuit or other programmable processor which is preferably a digital signal processor 90 having a plurality of programmable I/Os with each I/O programmed or coded to perform a specific function within the ballast circuit 10. For example, for each of the switches 58, 60, 70, 86 described above, the digital signal processor 90 includes an I/O which is programmed to control the switch. The control circuit 30 also includes gate drivers, preferably opto-isolators 94–98, which function to drive power MOSFET devices 72, 74, 75. In an alternate embodiment, a microprocessor or other type of programmable processing circuit is used in place of a digital signal processor 90. In the alternate embodiment of a full bridge MOSFET circuit within the output circuit 26 described above, an additional two opto-isolators would be required to drive the two additional power MOSFET devices.

In a preferred embodiment, the digital signal processor (DSP) 90 is a programmable processor supplied by Texas Instruments under part no. TMS 320LC2402A. Programming of the I/Os to perform the functions of the ballast circuit 10 is within the ability of one skilled in the art. A power supply 92 converts the low voltage output of the housekeeping/power supply circuit 22 to an even lower voltage, preferably between about 3.3 volts dc to about 5.0 volts dc, for operating the DSP 90. In an alternate embodiment of the control circuit 30, a microprocessor or other programmable processor, such as a Pentium III processor provided by Intel, is utilized in lieu of a DSP 90.

A communication port 100 is provided to enable electronic communication (including programming) with the DSP 90 from a peripheral device such as a computer or a communication network such as the Internet. In a preferred embodiment, the communication port 100 is an industry standard RS232 port. Alternatively, the communication port 100 is configured for communication via fiber optic, firewire, or other broadband data conduit.

A dimming interface 102 is also provided to enable the lamp 28 to be dimmed. In a preferred embodiment, dimming is performed automatically by the DSP 90 which determines how much the lamp 28 should be dimmed based on the output of an ambient light sensor. For ambient light sensors which produce an analog output, the sensor output would be converted to digital format (such as by an analog-to-digital converter) for processing by the DSP 90. However, it will be understood that dimming circuitry can be either analog or digital and that dimming can be done either manually or automatically. In any such embodiment, dimming is preferably achieved by increasing the lamp driving frequency. Increasing the lamp driving frequency reduces current to the lamp 28 with a consequent reduction in light output.

Figure 6A:
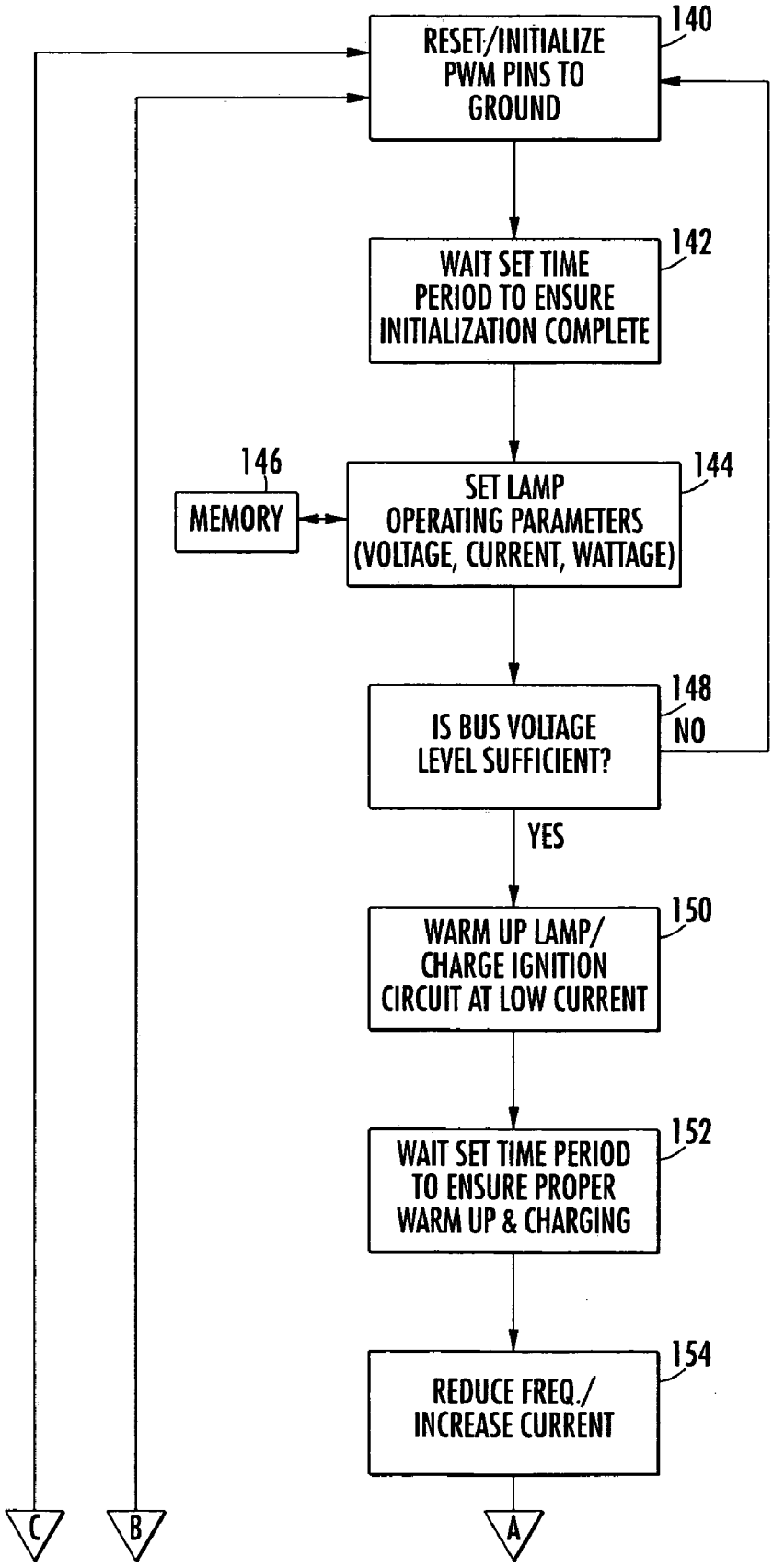
FIGS. 6A and 6B are a flow diagram for ignition and operation of a discharge lamp.
Figure 6B:
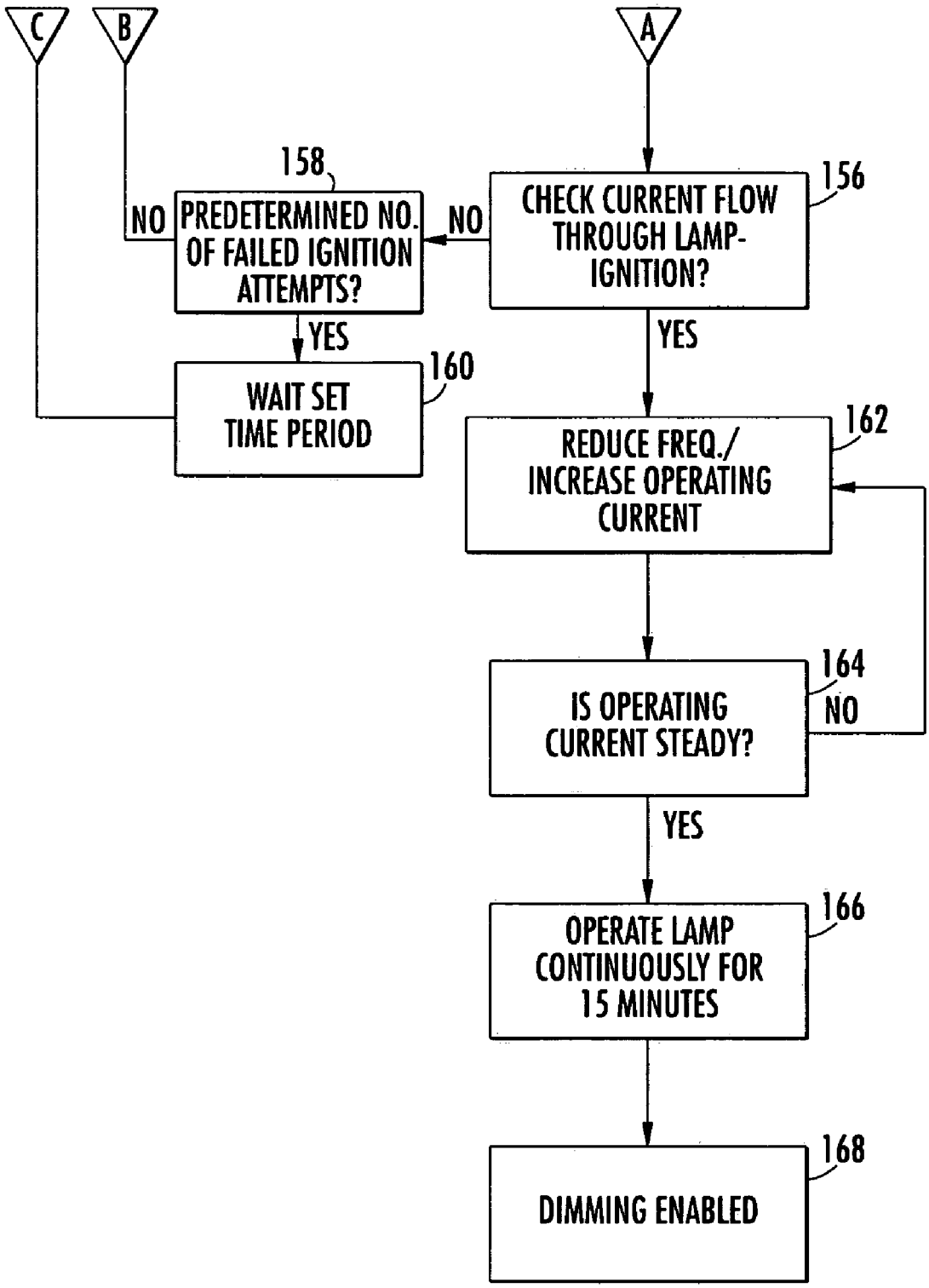

The ballast circuit may be configured to ignite discharge lamps of varying types and sizes by employing a progressive ignition sequence in which the DSP 90 produces an oscillating processor signal that is used to oscillate the output/supply circuit at a plurality of frequencies. A preferred method of progressive ignition and operation of a discharge lamp 28 is illustrated in the flow diagram of FIGS. 6A and 6B. Before ignition is attempted, one or more pulse width modulation (PWM) pins (on which oscillating processor signals are output) on the DSP 90 are reset or initialized to ground 140 and a set period of time (such as 3 seconds) is allowed to go by to ensure initialization is complete 142. Next, lamp operating parameters, including wattage, current and voltage, are set 144 for the particular lamp 28 (or lamps) to be ignited and sustained. Preferably, lamp operating parameters are conveniently stored in and retrieved from memory 146 for a variety of lamp types and sizes. After lamp parameters are set, the DSP 90 determines whether the bus voltage is sufficient to begin ignition 148. If sufficient voltage is not available, the process is started again at block 140. If voltage level is sufficient, low current is provided to the lamp 28 at high frequency in order to warm up the lamp 28 and charge the LC circuit 150. A set period of time (such as 3 seconds) is allowed to go by to ensure proper warm up and charging 152. Current is then increased by reducing the lamp driving frequency and current flow through the lamp 28 is checked to determine whether the lamp 28 has ignited 156. If the lamp 28 has not ignited, the DSP 90 checks to see how many times the lamp 28 has failed to ignite 158. If there have been less than a predetermined number (such as 10) of failed attempts to ignite the lamp 28, the process is started again at block 140. If there have been a predetermined number of failed ignition attempts, a set period of time (such as 3 minutes) is allowed to go by to enable the ballast circuit components and the lamp 28 to cool down before the process is started again at block 140.

When ignition is achieved, current flow to the lamp 28 is increased by reducing the lamp driving frequency. The DSP 90 then checks to see whether operating current is steady 164. If not, current is increased 162 or otherwise adjusted as necessary until current flow becomes steady. After the lamp 28 has been continuously operated for an industry-required minimum time period of 15 minutes 166, the lamp 28 can be dimmed 168. Current industry requirements allow a maximum of 50 percent dimming for many types of discharge lamps, so the DSP 90 is preferably programmed to allow dimming of up to 50 percent in accordance with the industry mandate.

In a preferred embodiment, ignition of the lamp 28 is accomplished in accordance with the above described progressive ignition sequence in which the frequency and energy level are progressively changed by the DSP 90 to ensure ignition occurs at an appropriate level of excitation. During progressive ignition, the LC circuit (inductor 66 and capacitor 69) is charged at high frequency for a period of time (such as 200 KHz for one second), then the control circuit 30 lowers the frequency to, for example, 130 KHz, to release energy from the LC circuit to try and ignite the lamp 28. In certain types of lamps, this action will produce approximately 1 KV peak-to-peak and a current of between about 5–10 amps. If insufficient current flow is detected by the control circuit 30 to indicate successful ignition, the process is repeated with more energy being released by the LC circuit. For example, after charging the LC circuit again for one second at 200 KHz, the frequency is dropped to 120 KHz with a resultant greater release of energy at, for example, 1.5 KV and 8–12 amps. If the lamp 28 still fails to successfully ignite, the process is again repeated with another advance in energy release, and the process is repeated until the lamp 28 is successfully ignited. If the lamp 28 fails to ignite after several attempts, the control circuit 30 will pause the progressive ignition process for a set period of time (such as 3 minutes) to allow time for the lamp 28 and other circuit components to cool. After ignition, the DSP 90 adjusts the frequency at which the output circuit is being oscillated to optimize post-ignition operation of the lamp 28.

While the oscillating processor signal output by the DSP 90 may be used to oscillate a lamp sustaining circuit that includes an inductor, the electronic ballast circuit 10 is preferably configured to provide for inductorless operation of the: lamp 28 after ignition. In general, this is achieved by programming the DSP 90 to produce an oscillating processor signal for use in operating the lamp 28 after ignition. The oscillating processor signal may be adjusted by the DSP 90 to oscillate the output/supply circuit at a plurality of frequencies to operate discharge lamps of varying types and/or sizes.

Figure 4:
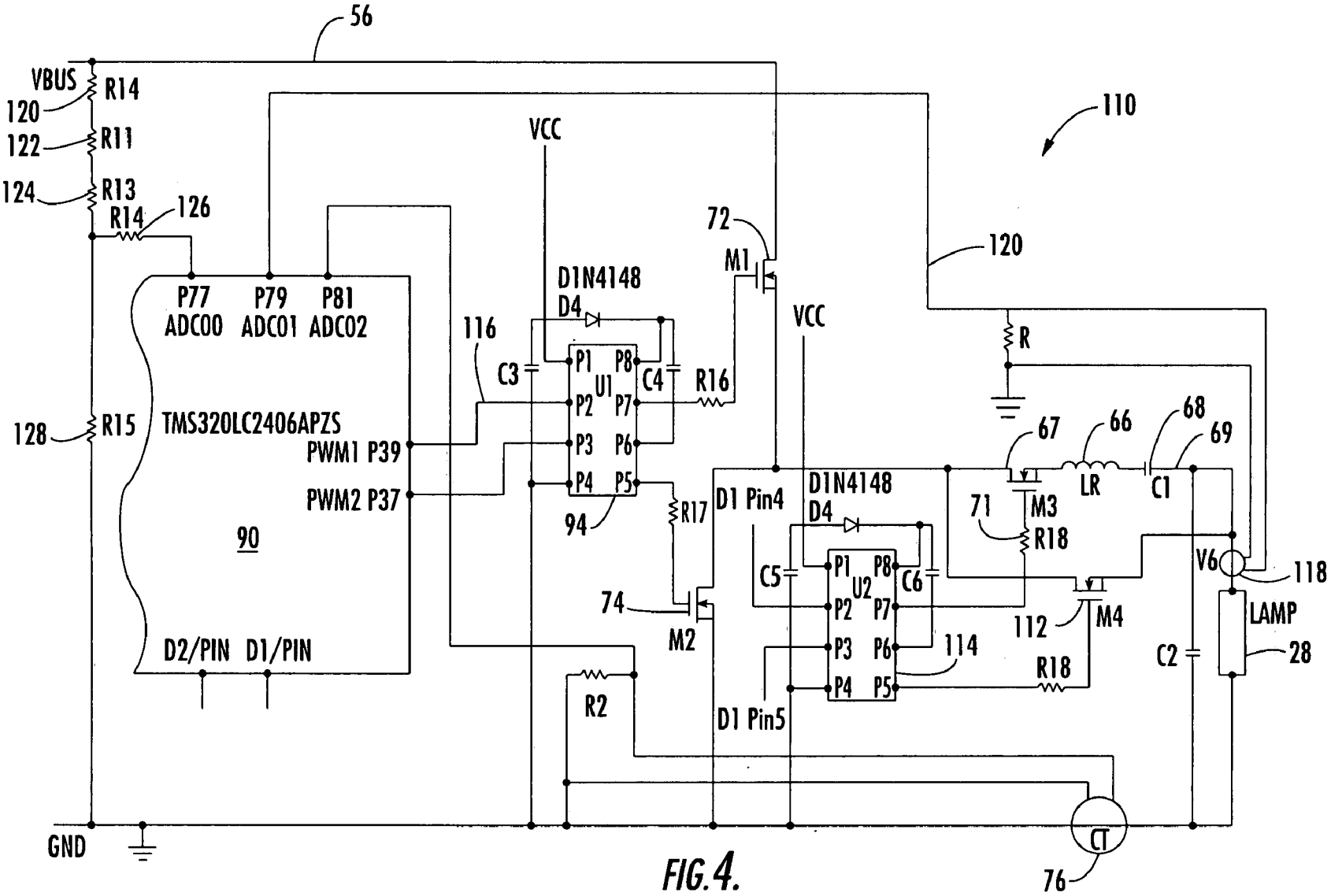
FIG. 4 is a schematic diagram showing elements of an electronic ballast circuit which enable inductorless operation after ignition of the lamp is achieved.

Inductorless operation of an electronic ballast circuit will now be further discussed with reference to the ignition and sustaining circuit 110 shown in FIG. 4 where conditioned power is provided on line 56 essentially as explained above. Resistors 120–128 function to monitor voltage on line 56. Resonant inductor 66, capacitor 68, ignition or power switch 67, and resistor 71 form part of an ignition circuit that provides an oscillating voltage signal on line 69 to ignite the lamp 28. Ignition or power switch 67 is preferably a double gated, power MOSFET transistor having a conductive state and a nonconductive state. The DSP 90 is programmed to turn on (i.e., place in a conductive state) switch 67 and switch 72 to establish an oscillating voltage signal on line 69. Thus, the DSP 90 is programmed to place the power switches 67, 72 into predetermined states during ignition (as well as operation) of the lamp 28. Voltage signal 69 is preferably oscillated at high frequency between about 60 KHz to about 500 KHz and at high voltage of about 1 KV or greater. The duty cycle of inductor 66 is very small, so the inductor 66 does not need to be physically large. Typically, ignition of the lamp 28 occurs relatively quickly, and so the inductor 66 can be very small since it only needs to handle peak current (between about 4–15 amps for most lamps) for a short period of time during ignition. Thus, inductor 66 can be designed to handle the peak current during ignition with little or no consideration given to running current parameters since the duty cycle is so low.

Ignition of the lamp 28 is sensed by current sensor 76 essentially as described above with the current sensor output being provided to the DSP 90, which forms a portion of the control circuit 30. After ignition, the DSP 90 acts in accordance with its programming to turn off (i.e., place in a nonconductive state) switch 67 and to turn on (i.e., place in a conductive state) an operating switch 112 (preferably a double gated, power MOSFET transistor) through gate driver 114 (preferably an opto-isolator). Thus, the DSP 90 is programmed to place the power switches 67, 112 into predetermined states during ignition and post-ignition operation of the lamp 28. Also in accordance with its programming, the DSP 90 outputs an oscillating signal on line 116 for use in operating the lamp 28. The oscillating signal on line 116 is then processed to produce an oscillating current signal suitable for post-ignition operation of the lamp 28. In a preferred embodiment, this is accomplished by providing the oscillating signal 116 to gate driver 94 for switch 72 to produce an oscillating current signal across switch 112 and lamp 28 to sustain ignition of the lamp 28.

Figure 5:
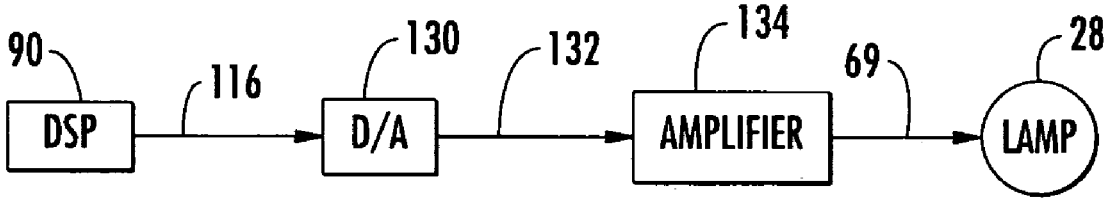
FIG. 5 is a functional block diagram showing aspects of an electronic ballast circuit which enable inductorless operation after ignition of the lamp is achieved.

In an alternate processing arrangement shown in FIG. 5, the oscillating signal 116 output by the DSP 90 is routed through a digital-to-analog converter 130. The analog output on line 132 is received by an amplifier 134 and the amplified signal is provided to the lamp 28 on line 69. This arrangement results in a smoother oscillating current signal on line 69 to operate the lamp 28 and eliminates the need to oscillate switch 72 with gate driver 94.

Referring again to FIG. 4, a voltage monitor 118 may be employed to provide on line 120 an indication to the DSP 90 of the voltage across the lamp 28. The voltage signal 120 may be advantageously used by the DSP 90 to provide a number of functions. For example, an unexpectedly high voltage level on line 120 (either during ignition or operation) could indicate an anomalous operating condition. In such an event, the DSP 90 could be programmed to shut down the circuit 110 as a safety precaution. The DSP 90 may also be programmed to adjust the oscillating signal on line 116 as needed to optimize operation of the lamp 28. It may also be possible for the DSP 90 to use the voltage feedback on line 120 to determine the type and/or wattage of lamp 28 being operated.

While many types of oscillating processor signals will suffice, a preferred oscillating processor signal is a sine wave or a square wave in pulse width modulated form. The oscillating signal 116 is preferably formatted to provide the proper amplitude and frequency needed for optimal operation of the particular lamp 28 being used. Programming of the DSP I/Os to produce such an oscillating signal and to configure the DSP 90 to function as described herein is within the ability of one skilled in the art. Also, as previously discussed, the DSP 90 can be programmed to format the oscillating signal 116 for operation of various sizes and types of lamps 28, which makes the operating circuit 110 highly versatile.

Elimination of the need for an operating inductor in accordance with the present invention provides a number of benefits, including reduced size, cost, weight, power consumption, heating, and EMI (electromagnetic interference). To illustrate such advantages, consider a 320 watt metal halide lamp that draws approximately 10 amps during ignition and approximately 2.5 amps during post-ignition operation. A single 124 micro Henry inductor can be used both to ignite and to sustain ignition of the lamp. As discussed above, a small inductor can be employed to handle the relatively small duty cycle required for ignition. However, use of the inductor to provide the excitation needed to sustain ignition for prolonged periods of time results in a significantly larger duty cycle, which mandates use of a much larger inductor that can handle the increased electrical and thermal stresses. The larger inductor adds cost, weight, and size to the ballast circuit. Additionally, the large amounts of current flowing through the inductor result in a great deal of heating, which in turn increases power consumption and adversely effects reliability of the ballast circuit. Moreover, since the inductor is used for ignition as well as post-ignition operation of the lamp, its duty cycle is essentially 100 percent. The present electronic ballast circuit does not suffer these problems.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the above mentioned description is to be considered exemplary, rather than limiting, and the true scope of the invention is that defined in the following claims and any equivalents thereof.

What is claimed is:

1. An electronic ballast for supplying electrical excitation to a filamentless discharge lamp, the electronic ballast comprising:

power conditioning circuitry for conditioning electrical power received from a source of electrical power, and producing a conditioned power signal; and a lamp supply circuit for receiving the conditioned power signal and producing electrical signals to operate the filamentless discharge lamp, said lamp supply circuit including:

a programmable processor operable to vary an operating parameter of the lamp supply circuit to enable operation of a plurality of lamp types or sizes, said programmable processor being further operable to oscillate the lamp supply circuit at 60 KHz or greater to avoid acoustic distortion and strobbing of the discharge lamp;

an ignition circuit for producing an oscillating voltage signal for igniting the discharge lamp;

a sustaining circuit for producing an oscillating current signal to sustain ignition of the discharge lamp; and a programmable inductor circuit having a plurality of inductance values, wherein said programmable processor is operable to select one of said plurality of inductance values for operation of a particular lamp type or size.

2. The electronic ballast of claim 1 wherein said programmable processor is further operable to produce an oscillating processor signal for use in oscillating the supply circuit at a plurality of frequencies to operate discharge lamps of different types or sizes.

3. The electronic ballast of claim 2 wherein said programmable processor oscillates the lamp supply circuit during ignition of the discharge lamp.

4. The electronic ballast of claim 2 wherein said programmable processor oscillates the lamp supply circuit after ignition of the discharge lamp.

5. The electronic ballast of claim 1 wherein said sustaining circuit is inductorless.

6. The electronic ballast of claim 1, further comprising:

a switch having a conductive state and a nonconductive state; and a driver for switching the switch between its conductive and nonconductive states based on an oscillating processor signal, thereby producing the oscillating current signal.

7. The electronic ballast of claim 1, further comprising:

a converter for converting an oscillating processor signal to analog format, and producing an analog oscillating signal; and an amplifier for amplifying the analog oscillating signal, and producing said oscillating current signal.

8. The electronic ballast of claim 1 wherein said power conditioning circuitry includes:

a filter circuit for removing noise from electrical power provided by the electrical power source, producing a filtered power signal;

a power factor correction circuit for adjusting the power factor of the filtered power signal to produce a corrected power signal; and a power supply circuit for converting electrical power received from the filtered power signal to a power level sufficient to operate the electronic ballast.

9. The electronic ballast of claim 1, further comprising a communication port for communicating with the programmable processor from a peripheral device.

10. The electronic ballast of claim 9 wherein said peripheral device is a computer.

11. The electronic ballast of claim 9 wherein said peripheral device is a communication network.

12. The electronic ballast of claim 1, further comprising a voltage monitor for monitoring the electrical signals provided to the discharge lamp, and producing a voltage monitor signal corresponding to the electrical signals sensed by the voltage monitor.

13. The electronic ballast of claim 12 wherein said programmable processor is further operable to control an oscillating processor signal based on the voltage monitor signal.

14. The electronic ballast of claim 1, further comprising a current monitor for monitoring the electrical signals provided to the discharge lamp, and producing a current monitor signal corresponding to the electrical signals sensed by the current monitor.

15. The electronic ballast of claim 14 wherein said programmable processor is further operable to control an oscillating processor signal based on the current monitor signal.

16. An electronic ballast for supplying electrical excitation to a filamentless discharge lamp, the electronic ballast comprising:

power conditioning circuitry for conditioning electrical power received from a source of electrical power, and producing a conditioned power signal; and a lamp supply circuit for receiving the conditioned power signal and producing electrical signals to ignite and sustain ignition of the filamentless discharge lamp, said lamp supply circuit including:

a programmable processor programmed to produce an oscillating processor signal for use in oscillating the supply circuit at a plurality of frequencies of 60 Khz or greater to enable the lamp supply circuit to operate discharge lamps of different types or sizes without acoustic distortion and strobbing;

an ignition circuit for receiving an oscillating processor signal and producing an oscillating voltage signal for igniting the discharge lamp;

a sustaining circuit for receiving an oscillating processor signal and producing an oscillating current signal to sustain ignition of the discharge lamp; and a programmable inductor circuit having a plurality of inductance values, wherein said programmable processor is operable to select one of said plurality of inductance values for operation of a particular lamp type or size.

17. The electronic ballast of claim 16 wherein said power conditioning circuitry includes:

a filter circuit for removing noise from electrical power provided by the electrical power source, producing a filtered power signal;

a power factor correction circuit for adjusting the power factor of the filtered power signal to produce a corrected power signal; and a power supply circuit for converting electrical power received from the filtered power signal to a power level sufficient to operate the electronic ballast.

18. The electronic ballast of claim 17, further comprising a communication port for communicating with the programmable processor from a peripheral device.

19. The electronic ballast of claim 18 wherein said peripheral device is a computer.

20. The electronic ballast of claim 18 wherein said peripheral device is a digital communication network.

21. The electronic ballast of claim 16, further comprising a voltage monitor for monitoring the electrical signals provided to the discharge lamp, and producing a voltage monitor signal corresponding to the electrical signals sensed by the voltage monitor.

22. The electronic ballast of claim 21 wherein said programmable processor is further operable to control the oscillating processor signal based on the voltage monitor signal.

23. The electronic ballast of claim 16, further comprising a current monitor for monitoring the electrical signals provided to the discharge lamp, and producing a current monitor signal corresponding to the electrical signals sensed by the current monitor.

24. The electronic ballast of claim 23 wherein said programmable processor is further operable to control the oscillating processor signal based on the current monitor signal.

* * * * *